US005722022A

United States Patent [19]

Park

[11] Patent Number: 5,722,022

[45] Date of Patent: Feb. 24, 1998

[54] DEVICE FOR REGULATING THICKNESS OF TONER LAYER ON DEVELOPING ROLLER

[75] Inventor: Dong-Hoon Park, Yongin-gun, Rep. of Korea

[73] Assignee: SamSung Electronics Co., Ltd., Suwon, Rep. of Korea

[21] Appl. No.: 657,679

[22] Filed: May 31, 1996

[30] Foreign Application Priority Data

May 31, 1995 [KR] Rep. of Korea ..... 14066/1995

[51] Int. Cl.[6] ..... G03G 15/06

[52] U.S. Cl. ..... 399/284; 399/274

[58] Field of Search ..... 399/236, 260, 399/267, 270, 274, 284, 285, 281; 430/120, 122

[56] References Cited

U.S. PATENT DOCUMENTS

| | | | |
|---|---|---|---|
| 4,444,864 | 4/1984 | Takahashi | 430/120 |
| 4,814,818 | 3/1989 | Fuma et al. | 399/274 |
| 5,170,213 | 12/1992 | Yamaguchi | 399/281 |
| 5,255,057 | 10/1993 | Stelter et al. | 399/285 |
| 5,285,243 | 2/1994 | Rimai et al. | 399/274 |
| 5,311,264 | 5/1994 | Kinoshita | 399/281 |
| 5,314,774 | 5/1994 | Camis | 430/47 |
| 5,365,318 | 11/1994 | Hiraoka et al. | 399/44 |
| 5,367,367 | 11/1994 | Ikeda et al. | 399/281 |
| 5,416,567 | 5/1995 | Toyoshima et al. | 399/283 |
| 5,428,428 | 6/1995 | Haneda | 399/276 |
| 5,519,472 | 5/1996 | Ojima et al. | 399/274 |
| 5,570,166 | 10/1996 | Ohzeki et al. | 399/270 |
| 5,594,198 | 1/1997 | Ikeda et al. | 399/281 |

FOREIGN PATENT DOCUMENTS 7-64394 3/1995 Japan .

*Primary Examiner*—Arthur T. Grimley
*Assistant Examiner*—Sophia S. Chen
*Attorney, Agent, or Firm*—R. E. Bushnell, Esq.

[57] ABSTRACT

An electrophotographic processor containing an image forming apparatus such as a laser printer, a copying machine, and a facsimile machine, is capable of regulating the thickness of toner layer formed on a developing roller so as to be a mono-layer. The electrophotographic image forming apparatus includes: a photosensitive drum rotating at a constant speed; a charging roller for charging a surface of the photosensitive drum; a developing roller for forming a toner image on a electrostatic latent image of the photosensitive drum by transferring toner from the developing roller to the drum; a supplying roller for supplying toner agitated by an agitator; and a doctor blade for regulating the toner layer on a developing roller device so as to be a uniform thickness. The doctor blade contacts the surface of the developing roller at a specific edge thereof, and is affixed to a bracket for supporting the doctor blade at an upper portion thereof, the bracket being affixed to a frame of a developing unit. The specific edge is disposed in a direction which is opposite to a direction of transfer of the toner from the developing roller to the drum.

19 Claims, 3 Drawing Sheets

DEVICE FOR REGULATING THICKNESS OF TONER LAYER ON DEVELOPING ROLLER

CROSS REFERENCE TO RELATED APPLICATIONS

This application make reference to, incorporates the same herein, and claims all benefits accruing under 35 U.S.C §119 from an application entitled Device for Regulating Thickness of Toner Layer on Developing Roller earlier filed in the Korean Industrial Property Office on the 31st day of May 1995 and there assigned Ser. No. 14066/1995.

BACKGROUND OF THE INVENTION

1. Field of the invention

The present invention relates to an electrophotographic image processor and, more particularly, to a process and device capable of regulating formation of a toner layer upon a developing roller to assure a mono-layer.

2. Description of the Related Art

In a conventional photographic image processor, toner is supplied from a toner storage unit and agitated with a carrier by a agitator so as to generate static electricity due to friction, thereby uniformly charging the toner. The developing material, formulated with the toner and carrier, is transferred onto the surface of a magnetic roller and a doctor blade is disposed with respect to the magnetic roller so as to cause the developing material to be formed on the surface of the magnetic roller with a uniform thickness. The toner is then transferred to a photosensitive drum after the drum has been exposed so as to cause an electrostatic static latent image to be formed thereon. The toner on the photosensitive drum forms a visual image by being attracted to the latent image formed on the drum and is subsequently transferred to a sheet of printing paper which then fixed by using heat and pressure.

Since the doctor blade contacts the surface of the roller, if the blade is not exactly straight, the doctor blade can not properly regulate the toner thickness. Furthermore, it is necessary to apply a high pressure to the doctor blade so as to press the doctor blade onto the surface of the roller, thereby causing the roller and the doctor blade to wear out quickly. Some prior art systems have utilized elastic doctor blades to avoid some of these noted problems. Doctor blades however, which press against the roller due to their elastic displacement can not properly control the thickness of the toner layer.

Rimai, et al., U.S. Pat. No. 5,285,243, Camis, U.S. Pat. No. 5,314,774, and Haneda, U.S. Pat. No. 5,428,428, are but three examples of efforts in the art to provide a developing device with a doctor blade that is electrically biased in an attempt to control the thickness of the toner on the developing roller. I have found that the mechanical arrangement of the doctor blades in these earlier efforts is less than fully effective.

Other efforts in the art including Takahashi, U.S. Pat. No. 4,444,864, Hiraoka, et al., U.S. Pat. No. 5,356,318, and Yamaguchi, et al., U.S. Pat. No. 5,170,213, focus upon elastic electrically biased conductive doctor blades. In each of these efforts, however, the edge of the doctor blade is disposed in a direction which is the same as the direction of the transfer of the toner from the developing roller to the drum, an arrangement that I believe to be less than satisfactory.

SUMMARY OF THE INVENTION

Accordingly, it is an object of the present invention to provide an improved process and imaging forming apparatus.

It is another object to provide a process and device capable of regulating a thickness of a toner layer on a developing roller without using an additional pressure mechanism.

It is still another object to provide a process and device capable of promoting a productivity by reducing the time required in manufacturing each part, since a precise straightness of a contact surface between a doctor blade and the developing roller is not required in the present invention.

It is yet another object to provide a process and device capable of regulating toner of a mono-layer due to a doctor blade contacting a surface of the developing roller at a specific edge thereof.

It is still yet another object to provide a process and device capable of forming a uniform toner layer, thereby forming an image having high resolution.

It is a further object to provide a process and device capable of collecting residual toner by using a supplying roller without having an additional cleaning device for removing residual toner.

It is a yet further another object to provide a process and device capable of reducing consumption of toner since residual toner is not generated.

These and other objects of the present invention may be attained with a rotating photosensitive drum having an electrostatic latent image formed thereon; a charging device, disposed adjacent said drum, for initially charging a surface of said photosensitive dram; a rotating developing roller for forming an toner image on an electrostatic latent image of said photosensitive drum by transferring toner from the developing roller to said drum; a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein the doctor blade contacts a surface of said developing roller at a specific edge thereof such that the edge is in a direction which is opposite to a direction of transfer of toner from the developing roller to said drum, and wherein the doctor blade is affixed to a bracket for supporting said doctor blade at an upper portion thereof, and the bracket is affixed to a frame of a developing unit.

BRIEF DESCRIPTION OF THE DRAWINGS

A more complete appreciation of this invention, and many of the attendant advantages thereof, will be readily apparent as the same becomes better understood by reference to the following detail description when considered in conjunction with the accompanying drawings, in which like reference symbols indicate, the same or similar elements or components, wherein.

DETAILED DESCRIPTION OF THE PREFERRED EMBODIMENT

Figure 1:
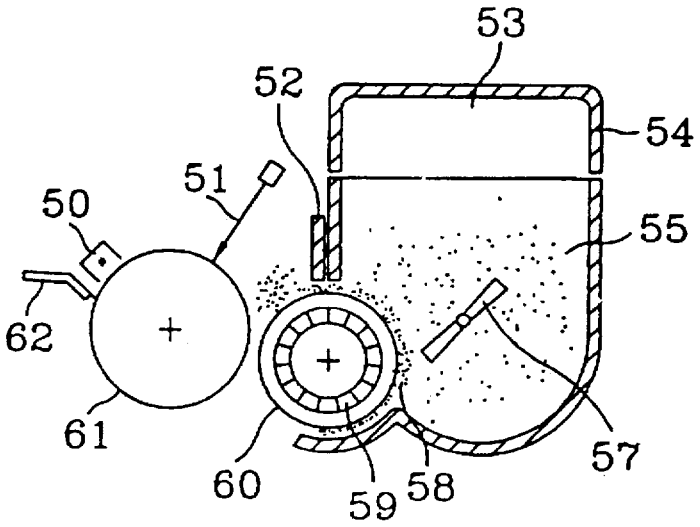
PRIOR ART Fig. 1
FIG. 1 is a schematic diagram illustrating the construction of a conventional image forming apparatus of a general electrophotographic processor.

Turning now to the drawings, FIG. 1 shows the construction of a generally used electrophotographic image forming apparatus. An explanation of the general printing process follows with reference to FIG. 1. When supplied to a toner storing unit 53, the toner 55 is agitated with a carrier 58 by an agitator 57 and generates a static electricity due to a friction, so as to have a uniform charge.

A developing material (i.e., the toner 55 and the carrier 58), charged as described above, is transferred onto the surface of a sleeve 60 through magnetic force of a magnetic roller 59. At this time, a doctor blade 52 enables the developing material to be formed on the surface of the sleeve 60 with a uniform thickness. The surface of a photosensitive drum 61 is electrically and uniformly charged by corona discharge of a charging unit 50 and then, if the surface of the photosensitive drum 61 is exposed by an electric signal received to form an image through an exposing unit 51, an electrostatic latent image is formed on a portion in light at an initially charged state.

To form a toner image, the electrostatic latent image is developed by toner by the passage of the developing roller (formed generally by magnetic roller 59 and sleeve 60) adjacent to the surface of the photosensitive drum 61, thus changing the latent image to a visual image. Subsequently, one sheet of printing paper from a stack of printing paper stacked in a paper feed cassette (not shown) is fed by a paper feed roller, and then the toner image on the surface of the photosensitive drum 61 is transferred to the printing paper through the high pressure of a transferring unit (also not shown).

While the transferred printing paper passes between a heating roller and a pressure roller of a fixing unit (not shown), the image is fixed on the printing paper by heat and pressure and then, the printed paper is transferred toward a paper discharge tray (not shown). As a result, the printing process can be desirably completed. In the meantime, there is residual toner and the latent image on the surface of the photosensitive dram 61. The residual toner is removed by a cleaning device 62 and the remanent charge is removed by a charge removing lamp (not shown).

Figure 2:
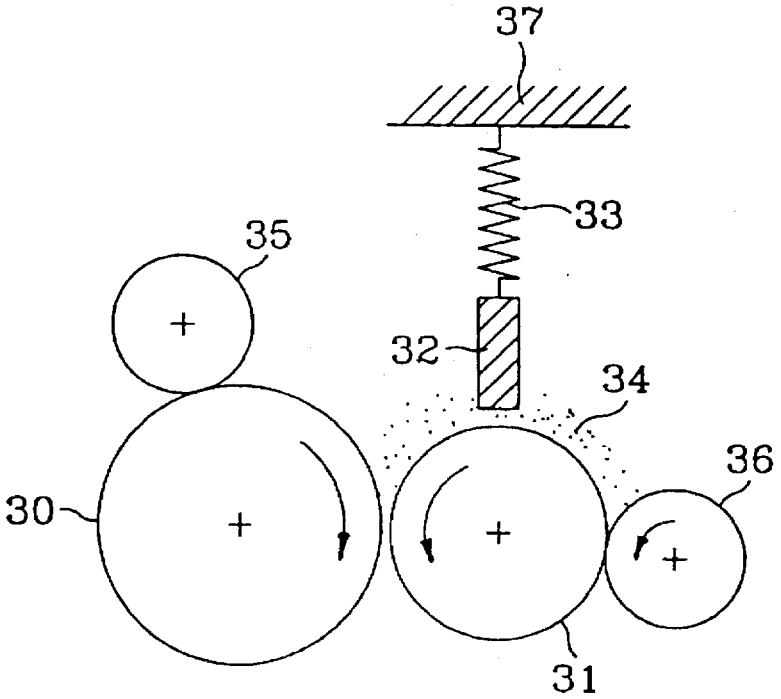
PRIOR ART Fig. 2
FIG. 2 is a sectional view illustrating the construction of a conventional device for regulating the thickness of a toner layer on a developing roller.

In FIG. 2, which is a cross sectional view illustrating the construction of the conventional device for regulating the thickness of the toner layer on developing roller 31, a photosensitive drum 30 rotates clockwise at a constant speed, a charging roller 35 for uniformly charging the surface of the photosensitive drum 30 is installed so as to be in contact with the surface of a photosensitive dram 30, and the developing roller 31 for forming the toner image from an electrostatic image on the surface of the photosensitive drum 30 is installed on one side of the photosensitive drum 30. A providing roller 36 for providing toner 34 agitated by an agitator (not shown) is installed on one side of the developing roller 31, and a doctor blade 32 for regulating the toner layer thickness on the developing roller 31 so as to be at a uniform thickness is vertically installed above the developing roller 31. Furthermore, a compression spring 33, which applies a given pressure to the doctor blade 32 so that the doctor blade contacts the surface of the developing roller 31, is affixed to a frame 37 of the developing unit above the doctor blade 32.

Hereinafter, the operation states of the device for regulating the thickness of toner layer on the developing roller constructed as previously described are explained in detail.

Toner 34, agitated by the agitator installed in the toner storing unit, is spread on the developing roller 31 as the providing roller 36 rotates counterclockwise and then the supplied toner 34 is transferred to the surface of the developing roller 31 through the magnetic force of the developing roller 31. The doctor blade 32 uniformly regulates the thickness of the toner 34 formed on the surface of the developing roller 31 by means of the pressure of the compression spring 33. As the developing roller 31 rotates counterclockwise, a toner image is formed on the surface of the photosensitive drum 30 by the toner 34 which is of a uniform thickness on the surface of the developing roller 31. The subsequent print operations are performed as explained above with regard to in FIG. 1 and accordingly, a detailed explanation thereof has been omitted.

In using the method as mentioned above, since the doctor blade contacts the surface of the developing roller 31 on one side thereof, if the contact surface of the developing roller 31 has an inaccurate straightness, the doctor blade 32 can not uniformly regulate the toner thickness and accordingly, toner 34 is unevenly formed on the surface of the developing roller 31. Therefore, an uneven toner image is formed on the surface of the photosensitive drum 30. In order to overcome the aforesaid problem, the developing roller 31, doctor blade 32 and the compression spring 33 have to be very precisely manufactured and therefore, the production cost of each part is increased. Furthermore, in order to regulate the toner so as to be a mono-layer of uniform thickness on the surface of the developing roller 31, the doctor blade 32 applies a high pressure to the surface of the developing roller 31 and therefore, the surface of the developing roller 31 is easily abraded. Furthermore, the torque applied to the developing roller 31, the doctor blade 32 and the compression spring 33 is high and therefore, they are easily destroyed.

Figure 3:
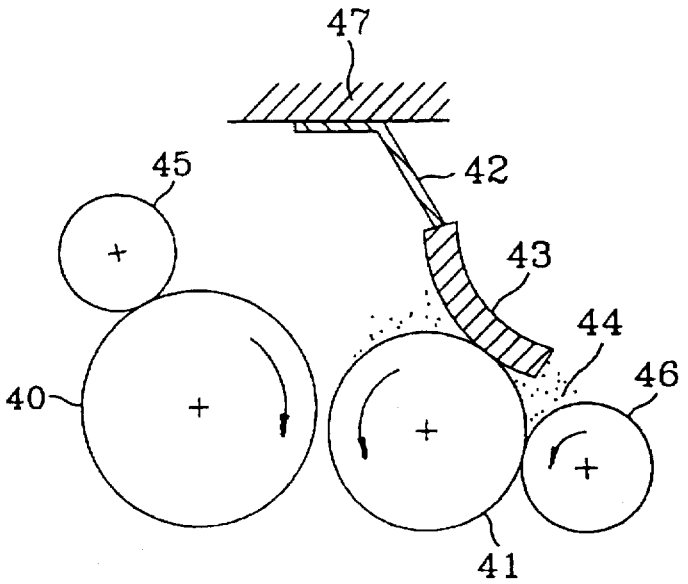
PRIOR ART Fig. 3
FIG. 3 is a sectional view illustrating the construction of another conventional device for regulating the thickness of a toner layer on a developing roller.

In FIG. 3, which is cross sectional view illustrating the construction of a conventional device for regulating the thickness of the toner layer on the surface of the developing roller, a photosensitive drum 40 rotates at a constant speed, and a charging roller 45 for electrically and uniformly charging the surface of the photosensitive drum 40 is installed so as to contact the surface of the photosensitive dram 40. A developing roller 41 for forming the toner image on the electrostatic latent image of the photosensitive drum 40 is installed on one side of the photosensitive drum 40, and a supplying roller 46 for supplying toner 44 agitated by an agitator (not shown) onto the developing roller 41 is installed on one side of the developing roller 41. A doctor blade 43 for regulating the thickness of the toner layer formed on the developing roller 41 is installed so as to contact the surface of the developing roller 41 at a specific side thereof so as to have an elastic displacement. A bracket 42 for supporting the doctor blade 43 is affixed to a frame 47 of the developing unit above the doctor blade 43.

An explanation of the operational states of the device for regulating the thickness of the toner layer on the developing roller constructed as described above follows.

As the supplying roller 46 rotates counterclockwise, toner 44 agitated by the agitator (not shown) installed in the toner storing unit is supplied onto the developing roller 41 and then, the supplied toner 44 is transferred onto the surface of the developing roller 41 through the magnetic force of the developing roller 41. The doctor blade 43 regulates the thickness of the toner 44 formed on the surface of the developing roller 41 so as to be uniform by means of its elasticity. As the developing roller 41 rotates counterclockwise, the toner image is uniformly formed on the surface of the photosensitive drum 40 by the toner 44 having a uniform thickness on the surface of the developing roller 41. The subsequent print operations are performed as explained above with regard to FIG. 1 and accordingly, a detailed explanation thereof has been omitted.

Using the method as described above, the doctor blade 43 contacts the surface of the developing roller 41 only by the pressure induced by its elastic displacement and therefore, the toner layer on the surface of the developing roller 41 can not be regulated so as to be a mono-layer. Furthermore, since the toner layer is unevenly formed on the surface of the developing roller 41 and accordingly, the thickness thereof is increased, the transfer efficiency is deteriorated, and toner 44 is unnecessarily consumed. Moreover, since the developing roller 41 is mechanically attached to the surface of the photosensitive drum 40 by a high pressure, a filming phenomenon occurs on the surface of the photosensitive drum 40 and thus, it is difficult to form an image having a high resolution.

Figure 4:
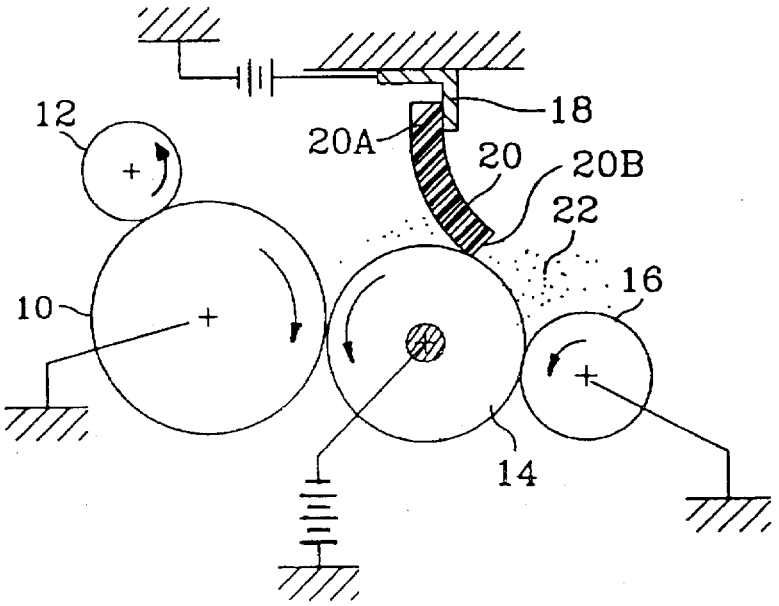
FIG. 4 is a schematic diagram illustrating a construction of a device for regulating the thickness of a toner layer on the developing roller constructed in accordance with the principles of the present invention.
Figure 5:
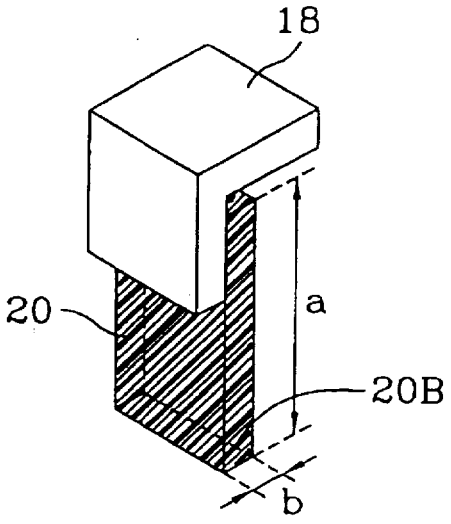
FIG. 5 is a perspective view illustrating how a doctor blade is affixed to a bracket as shown in FIG. 4.
Figure 6:
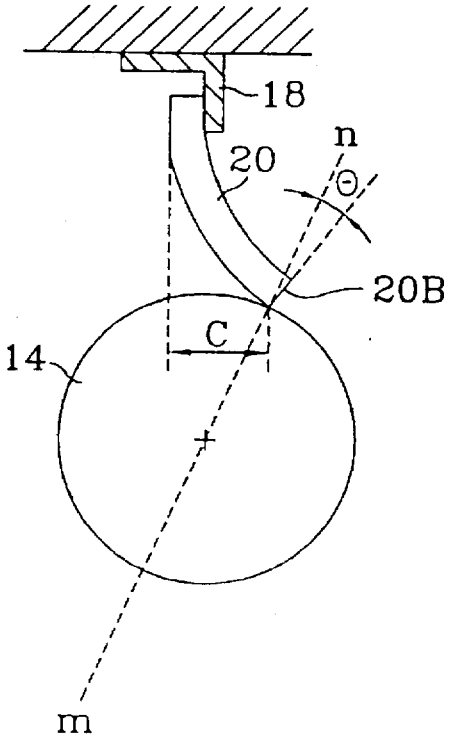
FIG. 6 is a schematic diagram illustrating a displacement and a contact angle of the doctor blade when the developing roller and the doctor blade contact each other.

Referring now collectively to FIGS. 4, 5 and 6, an embodiment of a preferred construction and operation of the present invention will be described in detail.

As shown in FIG. 4, a photosensitive drum 10 rotates clockwise at a constant speed, and a charging roller 12 for uniformly charging a surface of the photosensitive drum 10 is installed so as to contact the surface of the photosensitive drum 10, and a developing roller 14 for forming a toner image on an electrostatic latent image of the photosensitive drum 10 is installed on one side of the photosensitive drum 10. The developing roller 14 has a direct current voltage which is within the range of between about −200 V to −500 V applied thereto and is made of a conductive rubber material and has an electrical resistance which is within a range of $10^5\Omega$ to $10^8\Omega$.

A supplying roller 16 for supplying toner 22 agitated by an agitator (not shown) onto the developing roller 14 is installed on one side of the developing roller 14, and a doctor blade 20 for regulating the toner 22 layer formed on the developing roller 14 so as to be at a uniform thickness is installed above the developing roller 14. The doctor blade 20 contacts the surface of the developing roller 14 at a given pressure of 0.5~30 (grams/cm$^2$) at a specific edge 20B thereof. Furthermore, the specific edge 20B of the doctor blade 20 maintains an angle 6 of 0°~30° with respect to a normal m-n passing through a contact point of the doctor blade 20 and the developing roller 14 and a center of the developing roller 14.

Moreover, the doctor blade 20 is made of a conductive rubber which is an elastic material and having an elastic hardness (e.g., over 40 degrees) which is higher than that of the developing roller 14. A contact direction of the specific edge 20B of the doctor blade 20 and the developing roller 14 is opposite to a transfer direction of the toner 22 formed on the surface of the developing roller 14 to the drum 10, and the electrical resistance of the doctor blade 20 is within the range of $10^3\Omega$ to $10^8\Omega$. A bracket 18 having two perpendicular arms is provided for supporting the doctor blade 20 to one side 20A of the doctor blade 20. In the drawings, the doctor blade 20 is installed to the left of the bracket 18, but it may be installed to the right thereof. In order to apply a voltage to the doctor blade 20, the bracket 18 is made of conductive metal material capable of being electrically connected to a power supply.

Hereinafter, the operation and effects of the device constructed as previously described in accordance with the present invention is explained.

Toner 22 agitated by the agitator (not shown) installed in the toner storing unit is supplied the developing roller 14 as the supplying roller 16 rotates counterclockwise, and then supplied toner 22 is transferred to the developing roller 14 by the magnetic force of the developing roller 14. Hereafter, the doctor blade 20 regulates the toner 22 formed on the developing roller 14 so as to be at an uniform thickness and at the same time, controls the amount of toner 22 by means of the elasticity induced due to the elastic displacement thereof and the voltage provided through the bracket 18.

In FIG. 5, if a length (a) and a thickness (b) of the doctor blade 20 are respectively 15 mm and 2 mm as shown in FIG. 5, the elastic displacement (C) (shown in FIG. 6) of the doctor blade 20 is 2.5 mm. or thereabout. Then, as the developing roller 14 rotates counterclockwise at a higher speed (e.g., over 1.5 times higher) than the photosensitive drum 10, a toner image is formed on the surface of the photosensitive drum 10 by the toner 22 on the surface of the developing roller 14. Any residual toner 22 on the surface of the developing roller 14 is collected by the supplying roller 16. Subsequently, the print operations as explained above with respect to FIG. 1 are performed.

In the present invention, as discussed previously, the toner layer on the developing roller can be regulated by the elasticity of the doctor blade without the use of an additional pressure means, and the precise straightness of the contact surface between the doctor blade and the developing roller is not required. The time required in manufacturing each part is thereby reduced and accordingly, the productivity can be improved. Furthermore, since the doctor blade contacts the surface of the developing roller at a specific side thereof, the toner formed on the developing roller can be a mono-layer, thereby forming an image of a high resolution. Moreover, since the amount of toner is controlled by applying a voltage to the doctor blade and thus, the toner image is uniformly formed on the photosensitive drum, residual toner is not generated and accordingly, a cleaning device for removing residual toner is not required in the present invention.

It should be understood that the present invention is not limited to the particular embodiment disclosed herein as the best mode contemplated for carrying out the present invention, but rather that the present invention is not limited to the specific embodiment described in this specification except as defined in the appended claims.

What is claimed is:

1. A device for regulating a thickness of a toner layer in an electrophotographic image forming apparatus comprising:

a rotating photosensitive dram having an electrostatic latent image formed thereon;

a charging device, disposed adjacent said dram, for charging a surface of said photosensitive drum;

a rotating developing roller for forming a toner image on an electrostatic latent image of said photosensitive dram by transferring toner from the developing roller to said drum;

a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein said doctor blade contacts a surface of said developing roller at a corner of a specific edge thereof such that said edge is in a direction opposite to a direction of transfer of toner from said developing roller to said drum, and wherein said doctor blade is affixed to a bracket for supporting said doctor blade at an upper portion thereof, said bracket being affixed to a frame of a developing unit.

2. The device as claimed in claim, 1, wherein an electrical resistance of said developing roller is within a range of $10^5\Omega$~$10^8\Omega$.

3. The device as claimed in claim 1, wherein said developing roller is supplied with a direct current (DC) voltage which is in a range of −200 V to −500 V.

4. The device as claimed in claim 1, wherein said developing roller is composed of a conductive rubber material.

5. The device as claimed in claim 1, wherein said bracket is comprised of a conductive material which is electrically connected to a power supply for applying a voltage to said doctor blade.

6. The device as claimed in claim 5, wherein said bracket is composed of a metal.

7. The device as claimed in claim 1, wherein said doctor blade is composed of a conductive rubber material.

8. The device as claimed in claim 7, wherein an elastic hardness of said doctor blade is higher than that of said developing roller.

9. The device as claimed in claim 8, wherein the elastic hardness of said doctor blade is over 40 degrees.

10. The device as claimed in claim 1, wherein an electrical resistance of said doctor blade is within the range of $10^3\Omega$~$10^8\Omega$.

11. The device as claimed in claim 1, wherein said doctor blade contacts said developing roller with a given pressure caused by an elastic displacement of said doctor blade.

12. The device as claimed in claim 11, wherein said doctor blade contacts said developing roller with a pressure in the range of 0.5 to 30 g/cm$^2$.

13. The device as claimed in claim 1, wherein a ratio of the rotational speeds of said developing roller and said photosensitive drum is greater than 1.5:1.

14. The device as claimed in claim 1, wherein said specific edge of said doctor blade maintains a given angle with a normal passing through a contact point between said specific edge of said doctor blade and said developing roller and wherein said given angle is within a range of 0° to 30°, said given angle being positive in a direction opposite to the direction of rotation of said developing roller.

15. The device as claimed in claim 1, wherein said doctor blade has a length and thickness which are respectively on the order of 15 mm and 2 mm, and where an elastic displacement of the doctor blade is on the order of 2.5 mm.

16. A device for regulating a thickness of a toner layer in an electrophotographic image forming apparatus comprising:

a rotating photosensitive drum having an electrostatic latent image formed thereon;

a charging device, disposed adjacent said drum, for charging a surface of said photosensitive drum;

a rotating developing roller for forming a toner image on an electrostatic latent image of said photosensitive drum by transferring toner from the developing roller to said drum;

a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein said doctor blade contacts a surface of said developing roller at a specific edge thereof such that said edge is in a direction opposite to a direction of transfer of toner from said developing roller to said drum, and wherein said doctor blade is affixed to a bracket for supporting said doctor blade at an upper portion thereof, said bracket being affixed to a frame of a developing unit; said doctor blade being composed of a conductive rubber material having an elastic hardness which is over 40 degrees and is higher than that of said developing roller.

17. A device for regulating a thickness of a toner layer in an electrophotographic image forming apparatus comprising:

a rotating photosensitive drum having an electrostatic latent image formed thereon;

a charging device, disposed adjacent said drum, for charging a surface of said photosensitive drum;

a rotating developing roller for forming a toner image on an electrostatic latent image of said photosensitive drum by transferring toner from the developing roller to said drum;

a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein said doctor blade contacts a surface of said developing roller at a specific edge thereof such that said edge is in a direction opposite to a direction of transfer of toner from said developing roller to said drum, and wherein said doctor blade is affixed to a bracket for supporting said doctor blade at an upper portion thereof, said bracket being affixed to a frame of a developing unit; an electrical resistance of said doctor blade being within the range of $10^3\Omega$~$10^8\Omega$.

18. A device for regulating a thickness of a toner layer in an electrophotographic image forming apparatus comprising:

a rotating photosensitive drum having an electrostatic latent image formed thereon;

a charging device, disposed adjacent said drum, for charging a surface of said photosensitive drum;

a rotating developing roller for forming a toner image on an electrostatic latent image of said photosensitive drum by transferring toner from the developing roller to said drum;

a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein said doctor blade contacts a surface of said developing roller at a specific edge thereof such that said edge is in a direction opposite to a direction of transfer of toner from said developing roller to said drum, and wherein said doctor blade is affixed to a bracket for supporting said doctor blade at an upper portion thereof, said bracket being affixed to a frame of a developing unit; said doctor blade contacting said developing roller with a given pressure caused by an elastic displacement of said doctor blade and said pressure being within the range of 0.5 to 30 g/cm$^2$.

19. A device for regulating a thickness of a toner layer in an electrophotographic image forming apparatus comprising:

a rotating photosensitive drum having an electrostatic latent image formed thereon;

a charging device, disposed adjacent said drum, for charging a surface of said photosensitive drum;

a rotating developing roller for forming a toner image on an electrostatic latent image of said photosensitive drum by transferring toner from the developing roller to said drum;

a rotating supplying roller for supplying toner to said developing roller, said supplying roller being adjacent said developing roller; and an electrically biased elastic conductive doctor blade for regulating the thickness of a toner layer on said developing roller so as to be at a uniform thickness, wherein said doctor blade contacts a surface of said developing roller at a specific edge thereof such that said edge is in a direction opposite to a direction of transfer of toner from said developing roller to said drum, and wherein said doctor blade is affixed to a bracket for supporting said doctor blade at an upper portion thereof, said bracket being affixed to a frame of a developing unit; said doctor blade having a length and thickness which are respectively on the order of 15 mm and 2 mm, and an elastic displacement of the doctor blade being on the order of 2.5 mm.

* * * * *